US009357313B2

(12) United States Patent
Tanaka et al.

(10) Patent No.: US 9,357,313 B2
(45) Date of Patent: May 31, 2016

(54) MICROPHONE UNIT HAVING A PLURALITY OF DIAPHRAGMS AND A SIGNAL PROCESSING UNIT

(75) Inventors: Fuminori Tanaka, Osaka (JP); Ryusuke Horibe, Osaka (JP); Takeshi Inoda, Osaka (JP); Rikuo Takano, Ibaraki (JP); Kiyoshi Sugiyama, Tokyo (JP); Toshimi Fukuoka, Kanagawa (JP); Masatoshi Ono, Ibaraki (JP)

(73) Assignee: Funai Electric Co., Ltd., Osaka (JP)

( * ) Notice: Subject to any disclaimer, the term of this patent is extended or adjusted under 35 U.S.C. 154(b) by 585 days.

(21) Appl. No.: 12/424,226

(22) Filed: Apr. 15, 2009

(65) Prior Publication Data

US 2009/0290740 A1 Nov. 26, 2009

(30) Foreign Application Priority Data

Apr. 15, 2008 (JP) ..... 2008-106120

(51) Int. Cl.
*H04R 11/04* (2006.01)
*H04R 19/04* (2006.01)

(52) U.S. Cl.
CPC ..... *H04R 19/04* (2013.01); *Y10T 29/49005* (2015.01)

(58) Field of Classification Search
USPC ..... 381/355–361
See application file for complete search history.

(56) References Cited

U.S. PATENT DOCUMENTS

| | | | | |
|---|---|---|---|---|
| 6,522,762 | B1 * | 2/2003 | Mullenborn et al. | 381/174 |
| 2008/0175425 | A1 * | 7/2008 | Roberts et al. | 381/361 |
| 2008/0192963 | A1 * | 8/2008 | Sato | 381/174 |

FOREIGN PATENT DOCUMENTS

| | | | |
|---|---|---|---|
| JP | 2000-165998 | A | 6/2000 |
| JP | 2006-157863 | A | 6/2006 |
| JP | 2007-104556 | A | 4/2007 |

* cited by examiner

*Primary Examiner* — Raj R Gupta
(74) *Attorney, Agent, or Firm* — Osha Liang LLP

(57) ABSTRACT

A microphone unit includes a microphone substrate. A plurality of diaphragm units are disposed on the microphone substrate. Each of the diaphragm units includes a diaphragm. A plurality of partition walls are disposed on the microphone substrate. Each of the partition walls surrounds the diaphragm so as to define a first area. A signal processor is disposed at a second area outside the first area and is configured to process signals output from the diaphragm units.

13 Claims, 7 Drawing Sheets

FIG.3A
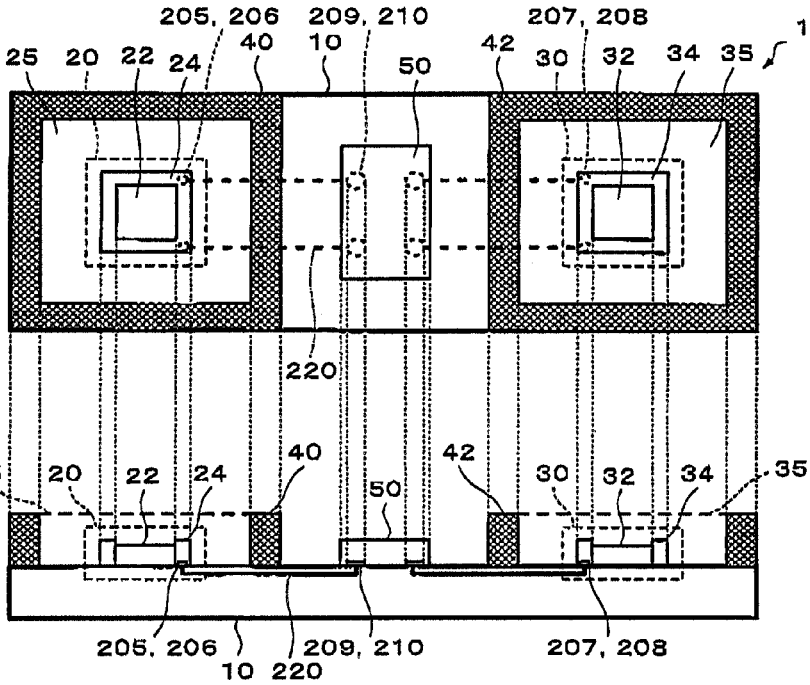
FIG.3B
FIG.4
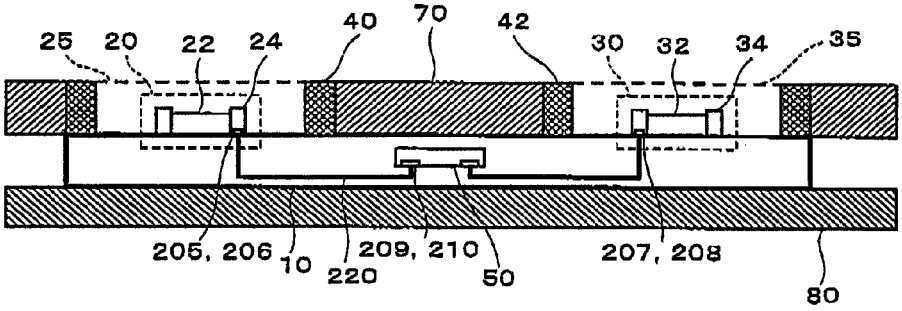

MICROPHONE UNIT HAVING A PLURALITY OF DIAPHRAGMS AND A SIGNAL PROCESSING UNIT

BACKGROUND

The present invention relates to a microphone unit and a method of manufacturing the same.

A technique for downsizing a sound input device has become important with a reduction in size of electronic equipment. For instance, a technique for manufacturing capacitor microphones on a silicon substrate has been developed as such a technique (see; for instance, Japanese Patent Publication No. 2006-157863 A).

For instance, a differential microphone that generates a differential signal showing a difference between voltage signals from two microphones and that utilizes the thus-generated differential signal has hitherto been known as a microphone having directivity. In particular, in order to realize a differential microphone having a superior high-frequency characteristic, it is important to match acoustic impedance of one microphone to that of the other microphone.

SUMMARY

According to one advantageous aspect of the present invention, there are provided a microphone unit that enables easy matching of acoustic impedances of a plurality of microphones to each other and a method for manufacturing the same.

According to one aspect of the invention, there is provided a microphone unit comprising:

a microphone substrate;

a plurality of diaphragm units disposed on the microphone substrate, each of the diaphragm units including a diaphragm;

a plurality of partition walls disposed on the microphone substrate, each of the partition walls surrounding the diaphragm so as to define a first area; and a signal processor disposed at a second area outside the first area and configured to process signals output from the diaphragm units.

The microphone unit may be configured such that volumes of spaces defined by the partition walls and the microphone substrate are identical each other.

The microphone unit may be configured such that shapes of openings of spaces defined by the partition walls and the microphone substrate are identical each other.

The microphone unit may be configured such that each of the diaphragm units is fitted into a space defined by the partition walls and the microphone substrate.

The microphone unit may be configured such that parts of the diaphragm units serve as the partition walls.

The microphone unit may be configured such that a face of the diaphragm is parallel to an opening of a space defined by the partition walls and the microphone substrate.

The microphone unit may be configured such that the signal processor is configured to execute a signal processing including generation of a differential signal based on signals output from two of the diaphragm units.

The microphone unit may be configured such that the signal processor is disposed at a position at which distances from the diaphragms of the diaphragm units are identical each other.

The microphone unit may further comprise a cover covering a space defined by the partition walls and the microphone substrate, the cover formed with a through hole communicating the space defined by the partition walls and the microphone substrate with outside of the cover.

According to another aspect of the invention, there is provided a method for manufacturing a microphone unit including a microphone substrate and a plurality of diaphragm units, each of the diaphragm units having a diaphragm, the method comprising:

providing a plurality of partition walls respectively surrounding a plurality of first areas on the microphone substrate;

providing the diaphragm units in an associated one of the first areas respectively; and providing a signal processor at a second area outside the first areas, the signal processor configured to process signals output from the diaphragm units.

BRIEF DESCRIPTION OF THE DRAWINGS

FIG. 3A is a plan view of a microphone unit according to a second embodiment of the present invention.

FIG. 3B is a sectional view of the microphone unit shown in FIG. 3A.

FIG. 4 is a sectional view showing a configuration of portable equipment mounting the microphone unit shown in FIG. 3A.

DETAILED DESCRIPTIONS OF EXEMPLIFIED EMBODIMENTS

Exemplified embodiments of the invention are described below in detail with reference to the accompanying drawings. The present invention is not limited to the embodiments described below. Moreover, the present invention covers appropriate combinations of specifics described below.

Figure 1A:
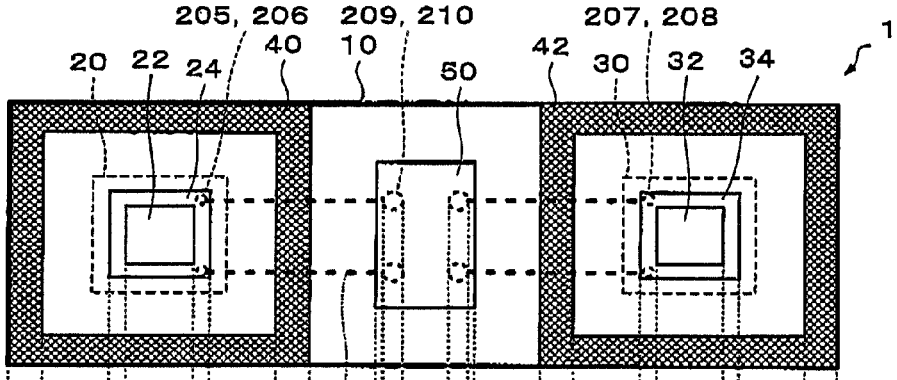
FIG. 1A is a plan view of a microphone unit according to a first embodiment of the present invention.
Figure 1B:
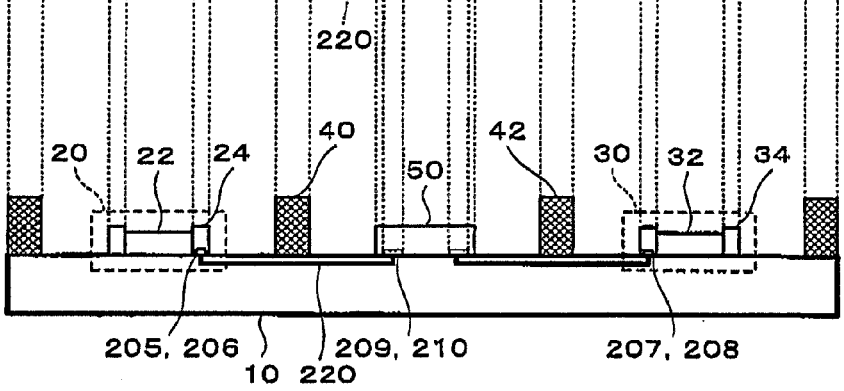
FIG. 1B is a sectional view of the microphone unit shown in FIG. 1A.
Figure 2:
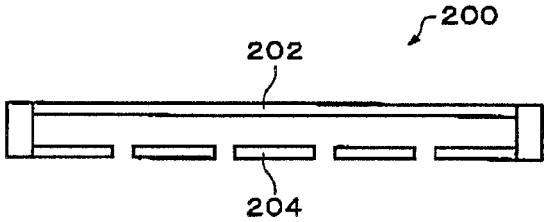
FIG. 2 is a view showing a configuration of a capacitor microphone mounting a microphone unit according to the present invention.

The configuration according to a microphone unit 1 of an embodiment of the present invention is described below with reference to FIGS. 1A, 1B, and 2.

The microphone unit 1 of the embodiment includes a microphone substrate 10. The microphone substrate 10 can be made of a material, such as an insulative molded material, baked ceramics, glass epoxy, and plastic.

The microphone unit 1 according to the present embodiment includes diaphragm units 20 and 30. The diaphragm unit 20 includes in part a diaphragm 22. Moreover, the diaphragm unit 20 may have a holding section 24 which holds the diaphragm 22. Likewise, the diaphragm unit 30 includes in part a diaphragm 32 and can have a holding section 34 for holding the diaphragm 32.

Diaphragm units 20 and 30 are disposed on the microphone substrate 10. In the present embodiment, an explanation is given to the microphone unit 1 having two diaphragm units; however, the microphone unit may have three or more diaphragm units.

The diaphragms 22 and 32 are members that vibrate in a normal direction by acoustic waves incident on the diaphragms. The microphone unit 1 outputs an electric signal in accordance with vibration of the diaphragm 22, thereby acquiring an electric signal representing sound incident on the diaphragm 22. Specifically, the diaphragms 22 and 32 are diaphragms of the microphone.

A configuration of a capacitor microphone 200 is described below as an example to which the above embodiment is applicable, with reference to FIG. 2.

A capacitor microphone 200 has a diaphragm 202. The diaphragm 202 corresponds to the diaphragms 22 and 32 of the microphone unit 1 according to the present embodiment. The diaphragm 202 is a membrane (a thin film) that generates vibration upon receiving acoustic waves, has conductivity, and serves as one end of an electrode. The capacitor microphone 200 has an electrode 204. The electrode 204 is disposed opposite in close proximity to the diaphragm 202. As a result, the diaphragm 202 and the electrode 204 constitute a capacitor. The diaphragm 202 vibrates by acoustic waves incident on the capacitor microphone 200, whereupon an interval between the diaphragm 202 and the electrode 204 changes, and electrostatic capacitance between the diaphragm 202 and the electrode 204 also changes. Changes in electrostatic capacitance are outputted as; for instance, voltage changes, whereby an electric signal based on vibration of the diaphragm 202 can be acquired. Specifically, acoustic waves incident on the capacitor microphone 200 can be transduced into and output as an electric signal. In the capacitor microphone 200, the electrode 204 may be structured so as be insensitive to acoustic waves. For instance, the electrode 204 may assume a meshed structure.

The present invention may be applied to the capacitor microphone and any of conventional microphones. For instance, the diaphragm 22 may be any of diaphragms of various microphones, such as an electrodynamic (dynamic) microphone, an electromagnetic (magnetic) microphone, and a piezoelectric (crystal) microphone.

Alternatively, the diaphragms 22 and 32 may be made of a semiconductor film (e.g., a silicon film). Specifically, the diaphragms 22 and 32 may be diaphragms of a silicon microphone (an Si microphone). The microphone unit 1 can be downsized and more sophisticated by using the silicon microphone.

Shapes of the diaphragms 22 and 32 are not particularly limited. In the present embodiment, shapes of vibration surfaces of the diaphragms 22 and 32 are square, but may be; for instance, circular, rectangular, or polygonal.

The microphone unit 1 according to the present embodiment includes partition walls 40 and 42. The partition walls 40 and 42 are disposed on the microphone substrate 10. The partition wall 40 and the partition wall 42 surround the diaphragm 22 of the diaphragm unit 20 and the diaphragm 32 of the diaphragm unit 30 respectively.

The shape of an opening of a space surrounded by the microphone substrate 10 and the partition walls 40 and 42 is not particularly limited. In the present embodiment, the shape of the opening is square, but may be; for instance, circular, rectangular, or polygonal. The diaphragm 22 is disposed in parallel to the opening.

Specifically, in the present embodiment, the diaphragm unit 20 is disposed in an area on the microphone substrate 10 surrounded by the partition wall 40. Likewise, the diaphragm unit 30 is disposed in an area on the microphone substrate 10 surrounded by the partition wall 42. With such a configuration, it is possible to realize a microphone unit that can easily match acoustic impedance of the microphone constituted by the diaphragm unit 20 to acoustic impedance of the microphone constituted by the diaphragm unit 30.

In the present embodiment, the volume of a space surrounded by the microphone substrate 10 and the partition wall 40 is made equal to the volume of a space surrounded by the microphone substrate 10 and the partition wall 42. Further, in the present embodiment, the shape of an opening of the space surrounded by the microphone substrate 10 and the partition wall 40 is made equal to the shape of an opening of the space surrounded by the microphone substrate 10 and the partition wall 42. By such configurations, a microphone unit that matches acoustic impedance of the microphone constituted by the diaphragm unit 20 to acoustic impedance of the microphone constituted by the diaphragm unit 30 can be realized.

The microphone unit 1 according to the present embodiment includes a signal processor 50. The signal processor 50 processes signal output from the diaphragm units 20 and 30. The signal processor 50 is disposed outside the areas on the microphone substrate 10 surrounded by the partition walls 40 and 42.

An electrode terminal 205 is provided in the area on the microphone substrate 10 surrounded by the partition wall 40 and electrically connected to an electrode terminal 206 of the diaphragm unit 20 by soldering, or the like. Likewise, an electrode terminal 207 is provided in the area on the microphone substrate 10 surrounded by the partition wall 42 and electrically coupled to an electrode terminal 208 of the diaphragm unit 30 by soldering, or the like. An electrode terminal 209 is provided outside the areas on the microphone substrate 10 surrounded by the partition walls 40 and 42 and electrically connected to an electrode terminal 210 of the signal processor 50 by soldering, or the like.

The electrode terminal 205 in the area on the microphone substrate 10 surrounded by the partition wall 40, the electrode terminal 207 in the area on the microphone substrate 10 surrounded by the partition wall 42, and the electrode terminal 209 provided outside the areas on the microphone substrate 10 surrounded by the partition walls 40 and 42 are electrically connected together by wiring 220 embedded in or on a substrate of the microphone substrate 10.

The signal processor 50 may execute signal processing including processing for generating a differential signal by using the signals output from the diaphragm units 20 and 30. As a result, the microphone unit 1 can serve as a differential microphone that employs the diaphragm units 20 and 30 as two microphones.

As in the case of the microphone unit 1 according to the present embodiment, the signal processor 50 is disposed outside the partition walls 40 and 42 enclosing the diaphragm units 20 and 30, whereby it becomes easy to make a volume of the space surrounded by the microphone substrate 10 and the partition wall 40 equal to a volume of the space surrounded by the microphone substrate 10 and the partition wall 42. Further, it becomes easy to make the shape of an opening of the space surrounded by the microphone substrate 10 and the partition wall 40 equal to the shape of an opening of the space surrounded by the microphone substrate 10 and the partition wall 42. Therefore, it is possible to realize a microphone unit capable of easily matching acoustic impedance of the microphone constituted by the diaphragm unit 20 to acoustic impedance of the microphone constituted by the diaphragm unit 30.

Further, the signal processor 50 may be disposed equidistantly away from the diaphragm 22 of the diaphragm unit 20 and from the diaphragm 32 of the diaphragm unit 30. A distance between the signal processor 50 and the diaphragms 22 and 32 may be identical to a distance between a representative point in the signal processor 50 and representative points in the respective diaphragms 22 and 32 or the wiring lengths from the signal processor 50 to the respective diaphragms 22 and 32. Thereby, influence caused by a difference between wiring resistance values or a difference between wiring capacitance values can be minimized, and a balance between electric signals can be maintained, so that a differential characteristic of the differential microphone can be improved.

The electrode sections 206 and 208 provided in the respective diaphragm units 20 and 30 are electrically connected to the electrode section 210 provided in the signal processor 50 by the wiring 220 laid on the face of the microphone substrate 10 or inside the microphone substrate 10. Both of the diaphragm units 20 and 30 provided on the microphone substrate 10 are preferably disposed so that the electrode sections 206 and 208 are disposed close to the side of the signal processor 50. Further, in the signal processor 50, the electrode section 210 to be connected to the electrode section 206 of the diaphragm unit 20 is preferably disposed closer to the diaphragm unit 20, and the electrode section 210 to be connected to the electrode section 208 of the diaphragm unit 30 is preferably disposed closer to the diaphragm unit 30. As a result, wiring resistance and wiring capacitance can be equalized and minimized by equalizing the lengths of wiring, and the differential characteristic of the differential microphone can be improved.

The microphone substrate 10 comprises a multilayer wiring board, and the wiring 220 is formed at an internal wiring layer of the microphone substrate 10 and shielded by upper and lower wiring layers, whereby electromagnetic disturbance noise acting on the wiring 220 can be inhibited.

A microphone unit according to a second embodiment of the present invention is described below with reference to FIGS. 3A and 3B. Members similar to those described in the first embodiment are designated by the same reference numerals, and repeated explanations for those will be omitted. In the present embodiment, in addition to the configuration described in the first embodiment, dust covers 25 and 35 are provided in an opening of a space surrounded by the microphone substrate 10 and the partition walls 40 and 42. For instance, the dust covers 25 and 35 are constituted by a metallic meshed plate having, in its cover surface, a plurality of minute pores of 0.2 mm or less in diameter, a felt material, or the like. It is possible to prevent occurrence of characteristic changes or operation failures in the diaphragm units 20 and 30, due to dust, and the like, by providing dustproof function to the diaphragm units without affecting acoustic frequency characteristics.

In a case that the microphone unit of the present embodiment is mounted in a housing 70 of portable equipment, such as a portable phone, an opening is formed in an area of the housing 70 corresponding to the partition wall 40 as indicated by a cross-sectional view shown in FIG. 4. The partition wall 40 is fitted into the opening, whereby a distance between a mount board 80 on which the microphone substrate 10 is mounted and the housing 70 can be shortened, and the thickness of the entire portable equipment set can be reduced.

In this case, the microphone substrate 10 may be a multilayer board, and the signal processor 50 may be embedded in the microphone substrate 10. The diaphragm units 20 and 30 may be electrically connected to the signal processor 50 by the internal wiring 220 of the microphone substrate 10.

Figures 5A, 5B:
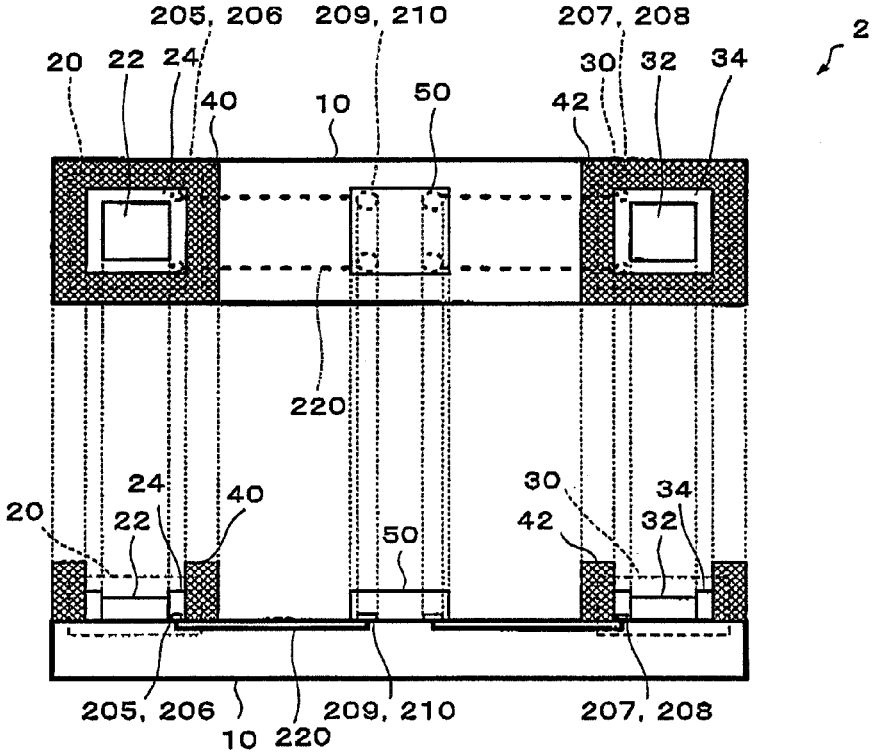
FIG. 5A is a plan view of a microphone unit according to a third embodiment of the present invention.
FIG. 5B is a sectional view of the microphone unit shown in FIG. 5A.

A microphone unit according to a third embodiment of the present invention is described below with reference to FIGS. 5A and 5B. Members similar to those described in the first embodiment are given the same reference numerals, and their repeated explanations are omitted.

The microphone unit 1 according to the first embodiment is configured such that clearance exists between the diaphragm unit 20 and the partition wall 40 and that clearance exists between the diaphragm unit 30 and the partition wall 42. However, the diaphragm unit 20 can be fitted into space surrounded by the microphone substrate 10 and the partition wall 40. Likewise, the diaphragm unit 30 can be fitted into space surrounded by the microphone substrate 10 and the partition wall 42.

In a microphone unit 2 according to the present embodiment, the diaphragm unit 20 is fitted into space surrounded by the microphone substrate 10 and the partition wall 40. Moreover, the diaphragm unit 30 is fitted into space surrounded by the microphone substrate 10 and the partition wall 42.

Further, in the present embodiment, the shape and the size of the space surrounded by the microphone substrate 10 and the partition wall 40 when viewed from its opening are substantially identical with the shape of the diaphragm unit 20 achieved when viewed from above. The diaphragm unit 20 is configured so as to be fitted into the space surrounded by the microphone substrate 10 and the partition wall 40.

Likewise, the shape and the size of the space surrounded by the microphone substrate 10 and the partition wall 42 achieved when viewed from its opening are made substantially identical with the shape of the diaphragm unit 30 achieved when viewed from above. The diaphragm unit 30 is fitted into space surrounded by the microphone substrate 10 and the partition wall 42.

By the microphone unit being configured as mentioned above, it is possible to easily match acoustic impedance of the microphone constituted by the diaphragm unit 20 to acoustic impedance of the microphone constituted by the diaphragm unit 30, and to make positioning performed during manufacturing operation easy and reliable.

Since components of the diaphragm units 20 and 30 are very small components approximately measuring 1 to 2 mm per side, handling of the components is difficult during implementing operation. In particular, when the electrode terminal 205 in the area on the microphone substrate 10 surrounded by the partition wall 40 and the electrode terminal 207 in the area on the microphone substrate 10 surrounded by the partition wall 42 are joined by soldering to the electrode terminal 206 of the diaphragm unit 20 and the electrode terminal 208 of the diaphragm unit 30 during reflow processes, a problem, such as rotation or positional displacement of components, is likely to arise.

However, in the above configuration, the diaphragm units 20 and 30 are positioned by the partition walls 40 and 42. Hence, even when the electrode terminal 205 in the area on the microphone substrate 10 surrounded by the partition wall 40 and the electrode terminal 207 in the area on the microphone substrate 10 surrounded by the partition wall 42 are joined to the electrode terminal 206 of the diaphragm unit 20 and the electrode terminal 208 of the diaphragm unit 30 during the reflow processes, occurrence of a problem, such as rotation or positional displacement of components, is prevented, and process yield can be increased.

Moreover, markings that enable perception of a direction of mount may be provided on the diaphragm units 20 and 30, or notch may be formed in portions of the diaphragm units 20 and 30. As a result, occurrence of mount failures can be prevented by using image recognition, and the like.

Figures 6A, 6B:
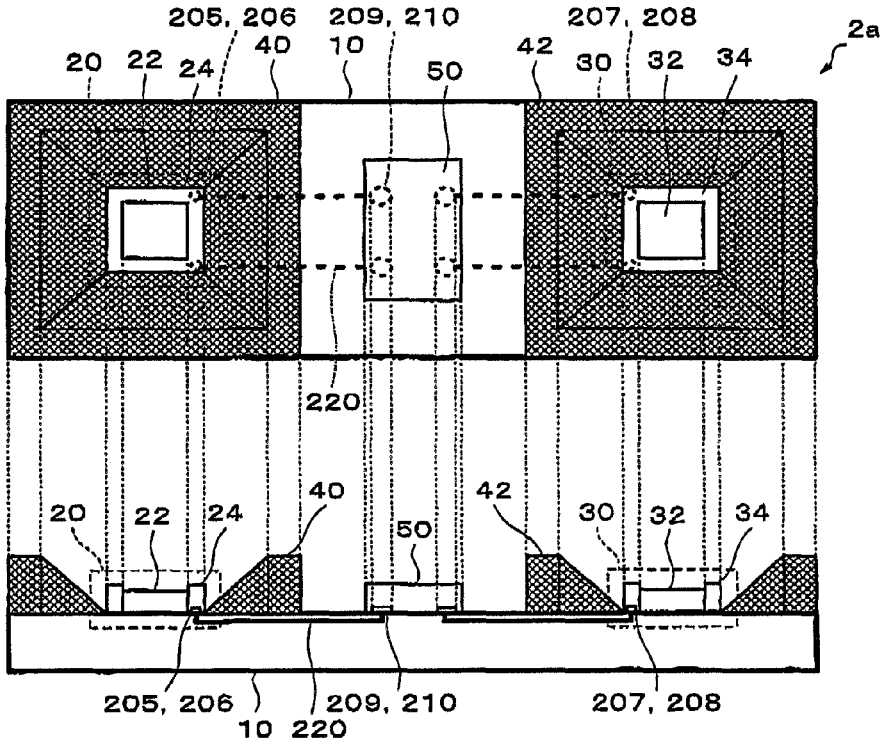
FIG. 6A is a plan view of a microphone unit according to a fourth embodiment of the present invention.
FIG. 6B is a sectional view of the microphone unit shown in FIG. 6A.

A microphone unit according to a fourth embodiment of the present invention is described below with reference to FIGS. 6A and 6B. Members similar to those described in the third embodiment are given the same reference numerals, and their repeated explanations are omitted.

In a microphone unit 2*a* according to the present embodiment, the partition walls 40 and 42 are tapered, and the diaphragm units 20 and 30 are fitted to their corresponding partition walls. It is preferable that the partition walls 40 and 42 are tapered such that the shape of the partition walls are identical with the shape of the diaphragm units 20 and 30 in terms of a shape at the bottom side of the microphone substrate 10 and that the area of each of openings becomes greater with an increasing distance from the microphone substrate 10. As a result, when the diaphragm units 20 and 30 are inserted into the respective spaces surrounded by the partition walls 40 and 42 and the microphone substrate 10 from the openings of the spaces, the diaphragm units 20 and 30 are automatically positioned at their target positions along the tapered shape, whereby fitting mount is facilitated. The tapered shape yields a sound-collecting effect, and an SNR (signal-to-noise ratio) can be increased. A material, such as metal, a resin, and rubber, can be used for the partition walls.

Figures 7A, 7B:
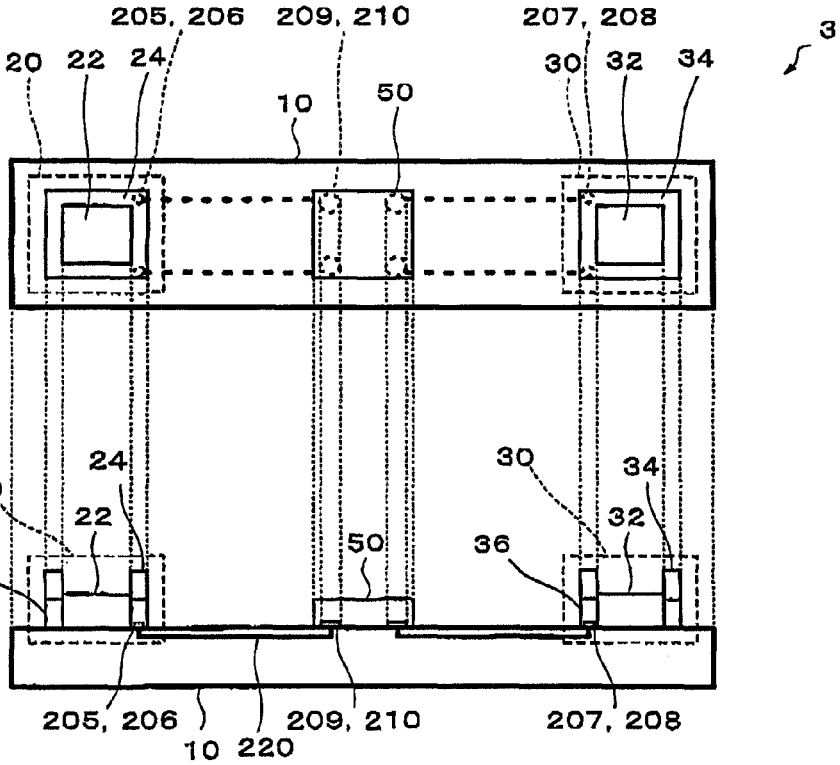
FIG. 7A is a plan view of a microphone unit according to a fifth embodiment of the present invention.
FIG. 7B is a sectional view of the microphone unit shown in FIG. 7A.

A microphone unit according to a fifth embodiment of the present invention is described below with reference to FIGS. 7A and 7B. Members similar to those described in the first embodiment are given the same reference numerals, and their repeated explanations are omitted.

In the embodiments described above, the diaphragm units and the partition walls are provided separately from each other. However, in the present embodiment, portions of the diaphragm units serve as partition walls.

In a microphone unit 3 of the present embodiment, the holding section 24 of the diaphragm unit 20 acts as a partition wall that encloses the diaphragm 22. Likewise, the holding section 34 of the diaphragm unit 30 serves as a partition wall that surrounds the diaphragm 32.

A space over the microphone substrate 10 can effectively be used by the diaphragm units serving as partition walls. Since there is no necessity for newly providing a partition wall, manufacturing processes can be simplified.

If a sufficient space in which the diaphragm 22 serves as a diaphragm of a microphone cannot be assured between the microphone substrate 10 and the holding section, the diaphragm unit 20 may include a spacer 26 between the holding section 24 and the microphone substrate 10, as necessary. Likewise, if a sufficient space in which the diaphragm 32 serves as a diaphragm of a microphone cannot be assured between the microphone substrate 10 and the holding section, the diaphragm unit 30 may include, as necessary, a spacer 36 between the holding section 32 and the microphone substrate 10.

Figures 8A, 8B:
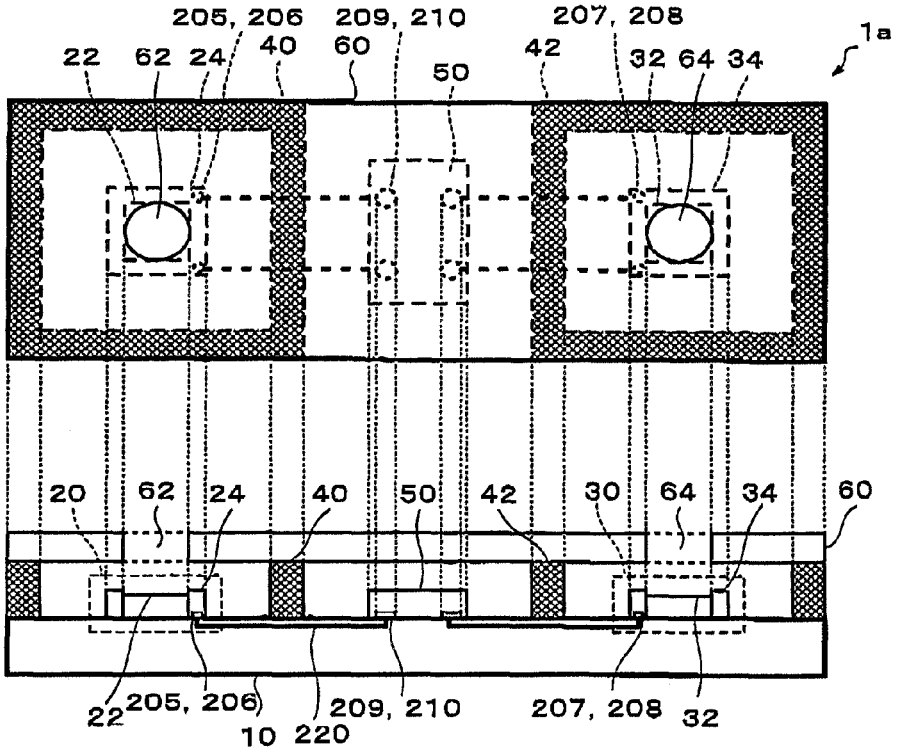
FIG. 8A is a plan view of a microphone unit according to a sixth embodiment of the present invention.
FIG. 8B is a sectional view of the microphone unit shown in FIG. 8A.

A microphone unit according to a sixth embodiment of the present invention is described below with reference to FIGS. 8A and 8B. Members similar to those described in the first embodiment are given the same reference numerals, and their repeated explanations are omitted.

In addition to the configurations of the aforementioned embodiments, the microphone unit has a cover that covers an opening face of a space surrounded by partition walls and a microphone substrate and a through hole that communicates the space surrounded by the cover, the partition walls, and the microphone substrate with the outside.

A microphone unit 1*a* according to the present embodiment has a cover 60, in addition to the configuration of the microphone unit 1 shown in FIG. 1.

The cover 60 covers an opening of the space surrounded by the partition wall 40 and the microphone substrate 10 and an opening of the space surrounded by the partition wall 42 and the microphone substrate 10. The cover 60 is formed with a through hole 62 communicating the space surrounded by the cover 60, the partition wall 40, and the microphone substrate with the outside. The cover 60 covers the entirety of an area other than an opening of the through hole 62 of the opening in the space surrounded by the partition wall 40 and the microphone substrate 10. Likewise, the cover 60 is formed with a through hole 64 communicating the space surrounded by the cover 60, the partition wall 42, and the microphone substrate with the outside. The cover 60 covers the entirety of an area other than an opening of the through hole 64 of the opening in the space surrounded by the partition wall 42 and the microphone substrate 10. Shapes of the openings of the through holes 62 and 64 are not particularly limited. Although the openings are circular in the present embodiment, the openings may be; for instance, rectangular or polygonal. Positions of the through holes are not particularly limited.

Since acoustic pressure input to the diaphragms is determined by the positions of the openings of the through holes, substantial positions of the microphones are determined by openings of the through holes rather than to the diaphragms. Therefore, in a case that the opening of the space surrounded by the partition wall and the microphone substrate is particularly wide, the substantial position of the microphone can be determined by providing the cover having the through hole. Therefore, designing of a microphone is facilitated.

Figure 9:
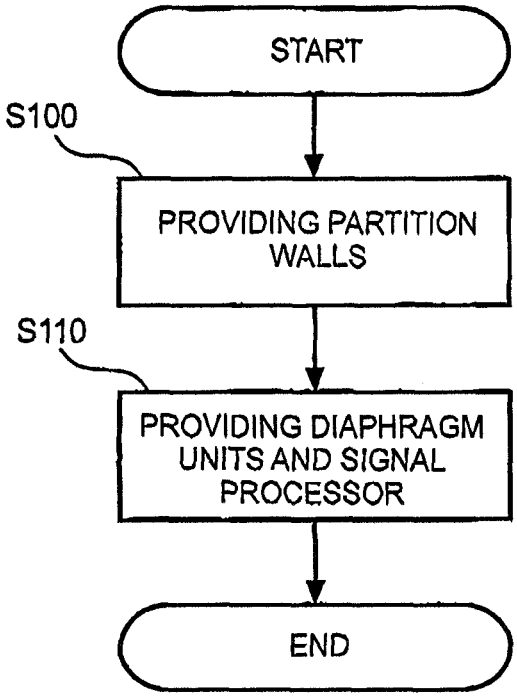
FIG. 9 is a flow chart showing an example of a manufacturing method of a microphone unit according to the present invention.

An example of method for manufacturing the microphone unit 1 is described with reference to FIG. 9.

First, partition walls that surround a plurality of areas where diaphragm units are to be disposed are provided on the microphone substrate 10 (step S100). In the present embodiment, the partition walls 40 and 42 are provided. The area where diaphragm units are to be disposed is an area on the microphone substrate 10 where the diaphragm units 20 and 30 are to be disposed.

The plurality of diaphragm units 20 and 30 are provided in an area where diaphragm units are to be disposed. The signal processor 50 for processing signals output from the diaphragm units 20 and 30 is provided outside the area on the microphone substrate 10 surrounded by the partition walls 40 and 42 (step S110).

A microphone unit capable of readily matching acoustic impedances of a plurality of microphones to each other can be manufactured through these procedures.

The present invention encompasses a configuration which is substantially the same as the configurations described with the embodiments (for example, a configuration from which the same function, method or result is obtained, or object or effect of which is the same). The present invention also encompasses a configuration in which a non-essential part in the configurations described with the embodiments is replaced. The present invention also encompasses a configuration from which the same advantageous effect can be obtained or by which the same object can be attained as in the configurations described with the embodiments. The present invention also encompasses a configuration wherein a well-know art is added to the configurations described with the embodiments.

For instance, the microphone unit having two diaphragm units is described in the descriptions about the embodiments. However, the present invention may similarly be applied to a microphone unit having three or more diaphragm units.

What is claimed is:

1. A microphone unit comprising:

a microphone substrate;

a plurality of diaphragm units disposed on the microphone substrate, each of the diaphragm units including a diaphragm;

a plurality of partition walls disposed on the microphone substrate, each of the partition walls surrounding the diaphragm so as to define a first area;

a first volume of space surrounded by a first partition wall of the plurality of partition walls and the microphone substrate;

a second volume of space surrounded by a second partition wall of the plurality of partition walls and the microphone substrate;

a signal processor disposed at a second area outside the first area and configured to process signals output from the diaphragm units;

a first electrode terminal provided on the microphone substrate in the first area;

a second electrode terminal provided on the microphone substrate in the second area; and a third electrode terminal provided on the microphone substrate in a third area, wherein a height of the partition walls from the microphone substrate is higher than a height of the diaphragm units from the microphone substrate, wherein each of the diaphragm units includes a holding part that holds the diaphragm and is disposed in direct contact with the microphone substrate, wherein each of the partition walls surrounds the holding part, wherein the first volume of space and the second volume of space are equal, wherein an electrode terminal of a first one of the diaphragm units and the first electrode terminal are electrically connected together in the first area, wherein an electrode terminal of the signal processor and the second electrode terminal are electrically connected together in the second area, wherein the first electrode terminal and the second electrode terminal are electrically connected together by a first wiring embedded in the microphone substrate, wherein an electrode terminal of a second one of the diaphragm units and the third electrode terminal are electrically connected together in the third area, wherein the third electrode terminal and the second electrode terminal are electrically connected to ether b a second wiring embedded in the microphone substrate, and wherein the first wiring and the second wiring are equal in length.

2. The microphone unit as set forth in claim 1, wherein shapes of openings of spaces defined by the partition walls and the microphone substrate are identical each other.

3. The microphone unit as set forth in claim 1, wherein each of the diaphragm units is fitted into a space defined by the partition walls and the microphone substrate.

4. The microphone unit as set forth in claim 1, wherein parts of the diaphragm units serve as the partition walls.

5. The microphone unit as set forth in claim 1, wherein a face of the diaphragm is parallel to an opening of a space defined by the partition walls and the microphone substrate.

6. The microphone unit as set forth in claim 1, wherein the signal processor is configured to execute a signal processing including generation of a differential signal based on signals output from two of the diaphragm units.

7. The microphone unit as set forth in claim 1, wherein the signal processor is disposed at a position at which distances from the diaphragms of the diaphragm units are identical each other.

8. The microphone unit as set forth in claim 1, further comprising:

a cover covering a space defined by the partition walls and the microphone substrate, the cover foamed with a through hole communicating the space defined by the partition walls and the microphone substrate with outside of the cover.

9. The microphone unit as set forth in claim 1, wherein the partition walls do not directly contact the diaphragms and respectively surround each of the diaphragms.

10. The microphone unit as set forth in claim 1, wherein each of the plurality of partition walls are substantially the same shape.

11. A method for manufacturing a microphone unit including a microphone substrate and a plurality of diaphragm units, each of the diaphragm units having a diaphragm, the method comprising:

providing a plurality of partition walls respectively surrounding a plurality of first areas on the microphone substrate;

providing a first volume of space surrounded by a first partition wall of the plurality of partition walls and the microphone substrate;

providing a second volume of space surrounded by a second partition wall of the plurality of partition walls and the microphone substrate;

providing the diaphragm units in an associated one of the first areas respectively;

providing a signal processor at a second area outside the first areas, the signal processor configured to process signals output from the diaphragm units;

providing a first electrode terminal on the microphone substrate in the first area;

providing a second electrode terminal on the microphone substrate in the second area;

providing a third electrode terminal on the microphone substrate in a third area, wherein a height of the partition walls from the microphone substrate is higher than a height of the diaphragm units from the microphone substrate, wherein each of the diaphragm units includes a holding part that holds the diaphragm and is disposed in direct contact with the microphone substrate, wherein each of the partition walls surrounds the holding part, and wherein the first volume of space and the second volume of space are equal, wherein an electrode terminal of one of the diaphragm units and the first electrode terminal are electrically connected together in the first area, wherein an electrode terminal of the signal processor and the second electrode terminal are electrically connected together in the second area, wherein the first electrode terminal and the second electrode terminal are electrically connected together by a wiring embedded in the microphone substrate, wherein an electrode terminal of a second one of the diaphragm units and the third electrode terminal are electrically connected together in the third area, wherein the third electrode terminal and the second electrode terminal are electrically connected together by a second wiring embedded in the microphone substrate, and wherein the first wiring and the second wiring are equal in length.

12. The method as set forth in claim 11, wherein the partition walls do not directly contact the diaphragms and respectively surround each of the diaphragms.

13. The method as set forth in claim 11, wherein each of the plurality of partition walls are substantially the same shape.

* * * * *